United States Patent [19]

Zeuner et al.

[11] Patent Number: 4,834,817

[45] Date of Patent: May 30, 1989

[54] GAS-GENERATING COMPOSITION

[75] Inventors: Siegfried Zeuner, Munich; Walter Holzinger, Deisenhofen, both of Fed. Rep. of Germany

[73] Assignee: Bayern-Chemie Gesellschaft Für flugchemische Antriebe mit Beschränkter Haftung

[21] Appl. No.: 252,519

[22] Filed: Sep. 30, 1988

[30] Foreign Application Priority Data

Oct. 1, 1987 [DE] Fed. Rep. of Germany ..... 3733176

[51] Int. Cl.[4] ..... C06B 35/00

[52] U.S. Cl. ..... 149/35; 149/61; 149/76; 280/741

[58] Field of Search ..... 149/35, 61, 76; 280/741

[56] References Cited

U.S. PATENT DOCUMENTS

| | | | |
|---|---|---|---|
| 3,931,040 | 1/1976 | Breazeale | 149/35 |
| 4,376,002 | 3/1983 | Utracki | 149/35 |
| 4,386,979 | 6/1983 | Jackson | 149/35 |

*Primary Examiner*—Stephen J. Lechert Jr.
*Attorney, Agent, or Firm*—Toren, McGeady & Associates

[57] ABSTRACT

A nitrogen-generating composition useful for inflating air bags as protection for occupants of motor vehicles is disclosed which is composed of an alkali and alkaline earth metal azide, an oxidizing agent which is an alkali or alkaline earth metal salt and an nitride, and optionally silicon dioxide. The nitride or combination of nitride and silicon dioxide are present in an amount effective to bind all of the alkali and alkaline earth metal as slag.

7 Claims, No Drawings

GAS-GENERATING COMPOSITION

FIELD OF INVENTION

This invention concerns a gas-generating composition useful for inflating air bags for protection of occupants of motor vehicles. More particularly, this invention is directed to a gas-generating composition wherein no water or toxic substances are formed during the gas-generating reaction and wherein the solid components resulting from the reaction are in the form of a glassy slag.

BACKGROUND OF INVENTION

Air bags for protection of motor vehicle occupants must be inflated by the gas-generating composition within a fraction of a second, and they are generally constructed so that their gas content is released at a controlled rate. The propellant formed for such air bags must not contain any toxic components.

Alkali and alkaline earth metal azides in particular, which form nonpoisonous gas consisting essentially of nitrogen when reacted with an inorganic oxidizing agent, come into consideration as the gas supplying component of such compositions. Alkali and alkaline earth metal oxides, which form during oxidation, are relatively difficult to separate and may reach the interior of the vehicle. To make the oxide harmless, it is known, for example, from German Aulegeschrift No. 2,236,175, that silicon dioxide may be added to the gas-generating composition. The silicon dioxide and the alkali and alkaline earth metal oxides form a glassy slag, the separation of which presents no problems.

The composition disclosed by German Auslegeschrift No. 2,236,175, as used in practice, contains 56% sodium azide on a weight basis, a relatively high proportion. Moreover, sodium azide is highly toxic, comparable in this respect to potassium cyanide. Due to the constant increase in the number of motor vehicles which are equipped with such protection equipment, the disposal problems which arise when scrapping are appreciable. These problems result both from direct contamination of the environment, particularly soil and subterranean water with this highly toxic salt, and from the reaction of sodium azide on the scrap heap with acids. For example, sodium azide can come into contact with bacterial acids to form highly explosive heavy metal azides.

Therefore, every effort is made to reduce the azide content of such compositions or to make do without azides. For example, azide-free compositions based on solid rocket fuels have been disclosed in German Auslegeschriften Nos. 2,334,063 and 2,222,506. However, these compositions have a serious disadvantage; carbon monoxide and other toxic gases are formed from the carbon containing components thereof.

To avoid carbon monoxide formation, the use of oxygen-free oxidizers, such as chromium chloride, molybdenum disulfide or iron fluoride and tetrazoles as a nitrogen source has been disclosed in European Patent No. 0,055,904. In these reactions, a propellant is formed which contains free metal, i.e. chromium, molybdenum or iron, and in some cases, substances which are even substantially more toxic, such as potassium cyanide. Furthermore, in view of the long time span over which an air bag must be usable, for example, more than ten years, the chemical stability of this composition leaves much to be desired.

According to German Offenlegungsschrift No. 2,407,659, a composition containing silicon nitride, sodium azide and ammonium perchlorate generates gas by reacting according to the following equation:

$$Si_3N_4+3NaN_3+3NH_4ClO_4 \rightarrow 3SiO_2+3NaCl+8N_2+6H_2O \quad (1)$$

As shown in equation (1), the reaction of this composition results in the formation of a relatively large amount of water, which condenses in the air bag. Further, due to the resulting heat of condensation, the air bag is heated, and aside from the mechanical stress, the bag material also has to withstand appreciable thermal stress. This problem is difficult to solve, because it runs counter to the desire, or necessity, of making the bag material as thin as possible, due to space constraints.

Another disadvantage of the composition disclosed by German Offenlegungsschrift No. 2,407,659 is that the ammonium perchlorate, which is used together with sodium azide, becomes acidic in contact with water and reacts with the formation of highly explosive and highly toxic hydrazoic acid. In practice, the complete absence of water cannot be attained, or requires an inordinate effort and expense.

Even though it is not evident from equation (1), in practice, the formation of hydrochloric acid, a toxic substance, from ammonium perchlorate is unavoidable. Finally, as shown in equation (1), sodium chloride is produced, and moreover, it is produced in finely divided form. The removal of sodium chloride creates difficulties; if it is not removed, it exerts an irritant effect on the occupants of the motor vehicle.

SUMMARY OF THE INVENTION

It is an object of the invention to provide a new gas-generating composition with a relatively low azide content and a high stability which is capable of forming at least an equally large volume of nitrogen from the same volume of gas-generating composition as known azide containing compositions.

Another object of the invention is to provide a new gas-generating composition with a relatively low azide content and a high stability which leads to a physiologically safe propellant and a solid residue which can be easily separated.

These and other objects are accomplished by the invention described below.

It has been discovered that a composition based on alkali or alkaline earth metal azides, an alkali or alkaline earth metal salt oxidizing agent and at least one nitride, wherein the nitride is present in an amount effective to bind the total alkali and alkaline earth metal as slag, has highly desirable characteristics as the gas-generating composition for inflating air bags used for motor vehicles. Optionally, the composition of the invention also contains silicon dioxide; when silicon dioxide is present together with the nitride, the amount of nitride and silicon dioxide is such that all alkali and alkaline earth metal is bound as slag.

DETAILED DESCRIPTION OF INVENTION

Due to the presence of nitride in an amount sufficient to bind the total alkali and alkaline earth metal in the gas-generating composition of the invention, the solid residue formed as a result of the gas-generating reaction is a glassy slag and can be readily separated. For example, if chromium nitride is used as the nitride, sodium azide as the azide and potassium nitrate as the inorganic oxidizing agent, the reaction of the gas-generating compositioin of the invention proceeds according to the following equation:

$$6CrN + 4KNO_3 + 2NaN_3 \longrightarrow \quad (2)$$

(% by wt.) (42.6) (43.4) (14.0)

$$2K_2O.3Cr_2O_3.Na_2O + 8N_2 + 1923 \text{ kj/mole}$$

As shown in equation (2) the total solid residue is bound in the form of $K_2O$ . $Cr_2O_3$ . $Na_2O$, as a glassy slag. Moreover, the sodium azide content is reduced to 14% by weight of the composition, which is a quarter of the sodium azide content of the composition disclosed in German Auslegeschrift No. 2,236,175.

Moreover, nitrogen is formed exclusively as the propellant; in particular, no water vapor is formed, which would lead to heat evolution when condensing.

According to the invention, boron nitride (BN), aluminum nitride (AlN), silicon nitride ($Si_3N_4$), and the transition metal nitrides, titanium nitride (TiN), zirconium nitride (ZrN), hafnium nitride (HfN), vanadium nitride (VN). niobium nitride (NbN), tantalum nitride (TaN), chromium nitride (CrN), and dichromium nitride ($Cr_2N$) are preferably used as the nitride.

With respect to the nitrides, it is important to note that although the proportion of nitrogen on a weight basis is appreciably less in the nitrides proferred according to the invention than in sodium azide, the proportion on a volume basis is comparable. For example, the proportion of nitrogen by weight in sodium azide is 64.6%; by volume it is 1.2 normal liters per cc. For CrN, the proportion by weight is only 21.2%; however, the proportion by volume is 1.02 normal liters per cc.

It follows from the foregoing, for example, that the mixture illustrated in equation (2) forms only 0.19 normal liters of nitrogen per gram, as compared with about 0.31 normal liters of nitrogen per gram which are generated by the known composition disclosed by German Auslegeschrift No. 2,236,175. However, due to the high density of the transition metal nitrides, the yield of gas on a volume basis is 0.72 normal liters per cc. for the composition of equation (2), compared with 0.65 normal liters for the known composition. In other words, despite the greatly reduced sodium azide content, the formation of nitrogen by the composition of the invention is comparable to that of a conventional gas-generating composition with a high azide content. This is an important characteristic with respect to the size of the gas generator.

To ensure that the nitride bonds with the alkali or alkaline earth metal, the nitrides, azides and alkali or alkaline earth metal salt employed as the oxidizing agent are used in stoichiometric ratios, as illustrated in equation (2). It is self evident that slight deviations from the stoichiometric ratios are possible, providing that the course of the reaction is not changed in such a way that the solid materials formed by the decomposition of the composition are no longer obtained in the form of a slag.

The nitrides preferably used in accordance with the invention, i.e. boron nitride. aluminum nitride, silicon nitride and the aforementioned nitrides of transition metals, are distinguished by an exceptionally high heat stability, and therefore, they are also used as ceramic materials. Accordingly, the composition of the invention is distinguished also by exceptional stability.

According to the invention, any alkali or alkaline earth metal salt with a strongly oxidizing anion can be used as the oxidizing agent. For practical reasons, potassium nitrate is preferred, since, despite a relatively low decomposition temperature, it is comparatively stable, hardly hygroscopic and, moreover, readily available.

In addition to the nitride, the composition of the invention may contain silicon dioxide. This means that a portion of the nitride can be replaced by silicon dioxide as the slag forming agent. In this case, the amount of nitride and of silicon dioxide should be such that the two together bond all of the alkali and alkaline earth metal as slag. For example, with a silicon nitride/silicon dioxide mixture in a ratio by weight of silicon ntiride to silicon dioxide of only 10:90 and only a slight reduction in the combustion chamber pressure, it has been possible to achieve a considerable increase in the air bag pressure and a distinct reduction in particle emission compared to that attainable when pure silicon dioxide is used to bond all of the alkali and alkaline earth metal. To detect this effect, it is necessary that the proportion of nitride in the mixture be at least 5 parts by weight, i.e. the slag forming agent must contain at least 5 parts by weight of silicon nitride and no more than 95 parts by weight of silicon dioxide. For the reasons mentioned however, the proportion of nitride in such a mixture is as high as possible and the absence of silicon dioxide and use of a nitride, exclusively, to bond all of the alkali and alkaline earth metal is preferred.

The following example further illustrates the invention, but must not be considered to limit the invention in any manner.

EXAMPLE

A 600 g. mixture of finely ground chromium nitride (CrN), potassium nitrate, and sodium azide was prepared in a molar ration of 3:2:1. The mixture was compressed into tablets with a diameter of 6 mm. and a thickness of 2.5 mm. About 80 g. of the tablets are introduces into a conventional gas generator housing for an air bag, as described in German Pat. No. 2,915,202 and ignited by means of an electrical igniter and a booster charge based on boron and potassiuim nitrate. The metal nitride burns with release of the theoretical amount of nitrogen.

We claim:

1. A gas-generating composition useful for inflating air bags as protection for occupants of motor vehicles comprising at least one alkali or alkaline earth metal azide, an inorganic oxidizing agent which is an alkali or alkaline earth metal salt and a nitride, and optionally silicon dioxide, wherein the nitride, or the combination of silicon dioxide and the nitride is present in an amount effective to bind all of the alkali and alkaline earth metal as slag.

2. The gas-generating composition of claim 1 which contains at least one alkali or alkaline earth metal azide, an inorganic oxidizing agent which is an alkali or alkaline earth metal salt and a nitride and wherein the nitride is present in an amount effective to bind all of the alkali and alkaline earth metal as slag.

3. The gas-generating composition of claim 1 which contains at least one alkali or alkaline earth metal azide, an inorganic oxidizing agent which is an alkali or alkaline earth metal salt, a nitride and silicon dioxide, wherein the combination of nitride and silicon dioxide is present in an amount effective to bind all of the alkali and alkaline earth metal as slag.

4. The gas-generating composition of claim 3, wherein the nitride is present in the combination of nitride and silicon dioxide in an amount of at least 5% by weight.

5. The gas-generating composition of claim 1 wherein the nitride is selected from boron nitride, aluminum nitride, silicon nitride and a nitride of a transition metal.

6. The gas-generating composition of claim 5, wherein the nitride of a transition metal is selected from titanium nitride, zirconium nitride, hafnium nitride, vanadium nitride, niobium nitride, tantalum nitride, and chromium nitride.

7. The gas-generating composition of claim 1, wherein the oxidizing agent is potassium nitrate.

* * * * *